US007639831B2

(12) United States Patent
Hagberg

(10) Patent No.: US 7,639,831 B2
(45) Date of Patent: Dec. 29, 2009

(54) SOUND EMITTING DEVICE WITH AN EXPANDABLE EARPIECE

(75) Inventor: Patrik Hagberg, Höllviken (SE)

(73) Assignee: Sony Ericsson Mobile Communications AB, Lund (SE)

( * ) Notice: Subject to any disclaimer, the term of this patent is extended or adjusted under 35 U.S.C. 154(b) by 781 days.

(21) Appl. No.: 11/284,042

(22) Filed: Nov. 21, 2005

(65) Prior Publication Data

US 2007/0116319 A1 May 24, 2007

(51) Int. Cl.
*H04R 25/00* (2006.01)

(52) U.S. Cl. ..... 381/380; 381/328

(58) Field of Classification Search ..... 381/322, 381/328, 330, 381; 181/135
See application file for complete search history.

(56) References Cited

U.S. PATENT DOCUMENTS

| | | | |
|---|---|---|---|
| 4,133,984 A | 1/1979 | Akiyama | |
| 4,834,211 A | 5/1989 | Bibby et al. | |
| 7,425,196 B2 * | 9/2008 | Jorgensen et al. | 600/25 |

* cited by examiner

*Primary Examiner*—Brian Ensey
(74) *Attorney, Agent, or Firm*—Myers Bigel Sibley & Sajovec

(57) ABSTRACT

A sound emitting device of the kind which is arrangeable at the ear of a user and which comprises an earpiece portion which fits inside the ear canal of the user. The earpiece portion comprises an expandable portion which upon expanding expands against the inside surface of the ear canal of the user. The sound emitting device further comprises a compressible element which is filled with a fluid and which is connected to said expandable portion whereby fluid is transferred to said expandable portion causing it to expand upon compression of said compressible element. The sound emitting device further comprises a compression mechanism for compressing the compressible element and which is adjustable by the user to adjust the amount which the compressible element is compressed.

15 Claims, 5 Drawing Sheets

SOUND EMITTING DEVICE WITH AN EXPANDABLE EARPIECE

FIELD OF INVENTION

The current invention relates to a sound emitting device of the kind which is arrangeable at the ear of a user.

BACKGROUND

Sound emitting devices of the kind referred to above have been disclosed in the patent literature, but are not commonly available in the market. The devices of this type can be used for many different purposes. One example of such a sound emitting device is a hearing aid. Another example is an earphone for a portable music player. Another example is a headset for a mobile phone.

U.S. Pat. No. 4,133,984 and U.S. Pat. No. 4,834,211 disclose two different examples of sound emitting devices as mentioned in the opening paragraph. Both documents primarily disclose hearing aids, but U.S. Pat. No. 4,133,984 also discloses the use of the sound emitting device as a headphone for an electronic device.

The prior art discloses a number of different inflation mechanisms for inflating the expandable portion of the earpiece. However, the disclosed mechanisms rely on complicated hydraulic or pneumatic systems with integrated check valves, bladders, on/off valves, etc. These mechanisms are therefore rather expensive and complicated to manufacture resulting in high costs. In addition, they are rather difficult for the user to operate since the user needs to manipulate small parts. Other systems rely on external inflating aids which the user is required to carry around.

SUMMARY

A first aspect of the current invention is therefore to provide a sound emitting device as mentioned in the opening paragraph which is easy to operate.

A second aspect of the current invention is to provide a sound emitting device as mentioned in the opening paragraph which is simple to manufacture.

A third aspect of the current invention is to provide a sound emitting device as mentioned in the opening paragraph which is robust.

The above mentioned aspects are solved in part in that said sound emitting device further comprises a compression mechanism for compressing the compressible element and in that said compression mechanism is adjustable by the user to adjust the amount which the compressible element is compressed. Since in this case, it is a mechanical compression mechanism which compresses the compressible element, the compressible element and expandable element can be made very simple. There is no need for check valves, on/off valves, etc . . . In addition, since the user interacts with a mechanical compression mechanism, it is easy for the user to adjust the device. Furthermore, since the mechanism is comprised of simple mass produced components which are easily and quickly assembled, the resulting device is robust and simple to manufacture.

In a preferred embodiment, the compression mechanism could comprise a displaceable element which when displaced in a first direction compresses the compressible element. In this way, the compression mechanism and the compressible element are two distinct entities where the displaceable element of the compression mechanism is the interface between the two.

In a preferred embodiment, the compressions mechanism can be designed in such a way that when the user has finished adjusting the compression mechanism, the displaceable element can be held in position via friction. In another embodiment, the displaceable element can be held in place by a ratchet mechanism.

In order to make removal of the earpiece easier, the compression mechanism could further comprise a quick release mechanism whereby the pressure applied by the compression mechanism on the compressible element is quickly releasable. In this way, the expandable element can quickly be changed from its expanded state to its retracted state.

In a preferred embodiment of the compression mechanism, it could comprise a wedge mechanism. This allows the force applied by the user to be increased. Another way of amplifying the force applied by the user is when the compression mechanism comprises a screw mechanism. In another embodiment, the compression mechanism could comprise a pivoting element. With the use of a pivoting element, the lever effect can be used to amplify the force applied by the user. The compression mechanism could also comprise a gear assembly. In this way, the force or the displacement can be multiplied.

In a preferred embodiment, the expandable portion and the compressible element could be parts of a sealed system which is filled with a fluid. Due to the sealed nature of the system, a simple and leak-proof system is provided. In a preferred embodiment, the fluid is a liquid. In this way, the amount of compression of the compressible element necessary is reduced since a liquid is not compressible.

As mentioned in the introduction, the sound emitting device according to the current invention can be used for many purposes. One of those purposes is as a headset for use with a mobile radio terminal, such as a mobile phone. In one particular embodiment of such a device, the device could comprise means for communicating with a mobile radio terminal. Such means could for example be a wireless system such as Blue-Tooth.

It should be emphasised that the term "comprises/comprising" when used in this specification is taken to specify the presence of stated features, integers, steps or components but does not preclude the presence or addition of one or more other features, integers, steps, components or groups thereof.

It should also be emphasised that the term "means for" when used in this specification should be taken to include all the embodiments of means which would be suitable for performing the specified function. This includes all the embodiments described in this application, as well as those embodiments which would be obvious to the person skilled in the art.

BRIEF DESCRIPTION OF DRAWINGS

The invention will now be described in more detail with reference to the example embodiments shown in the figures.

Figure 1:
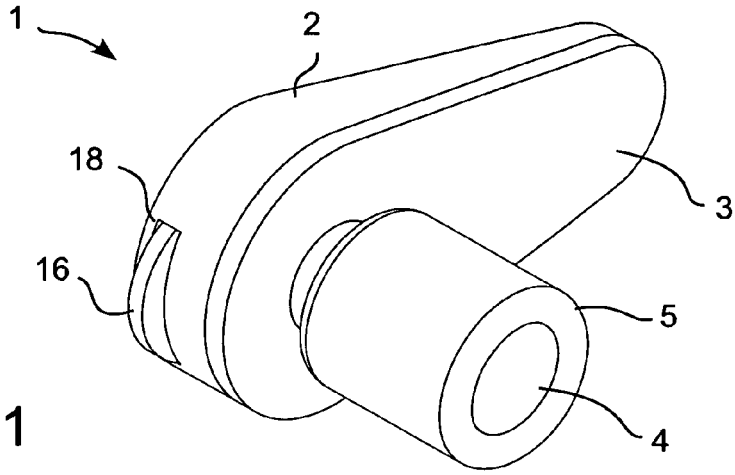
FIG. 1 shows a perspective view of a first embodiment of a sound emitting device according to the current invention.
Figure 2:
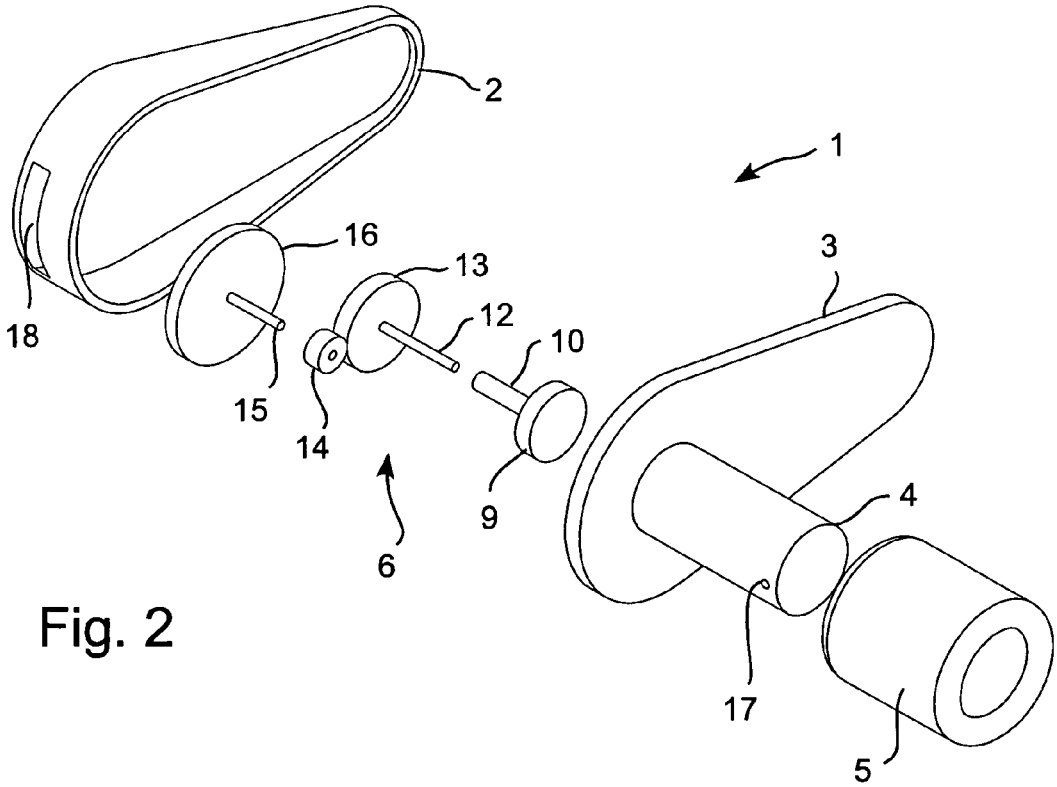
FIG. 2 shows an exploded perspective view of the first embodiment.
Figure 3:
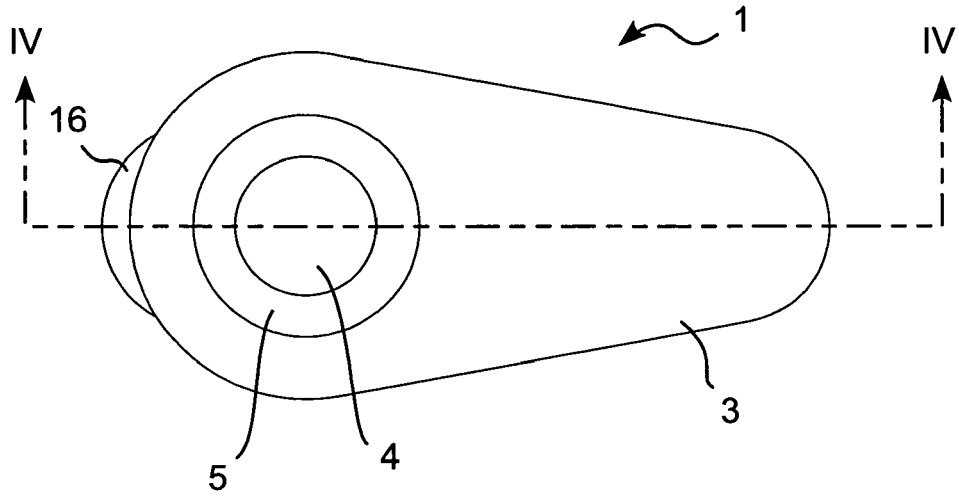
FIG. 3 shows a front view of the first embodiment.
Figure 4:
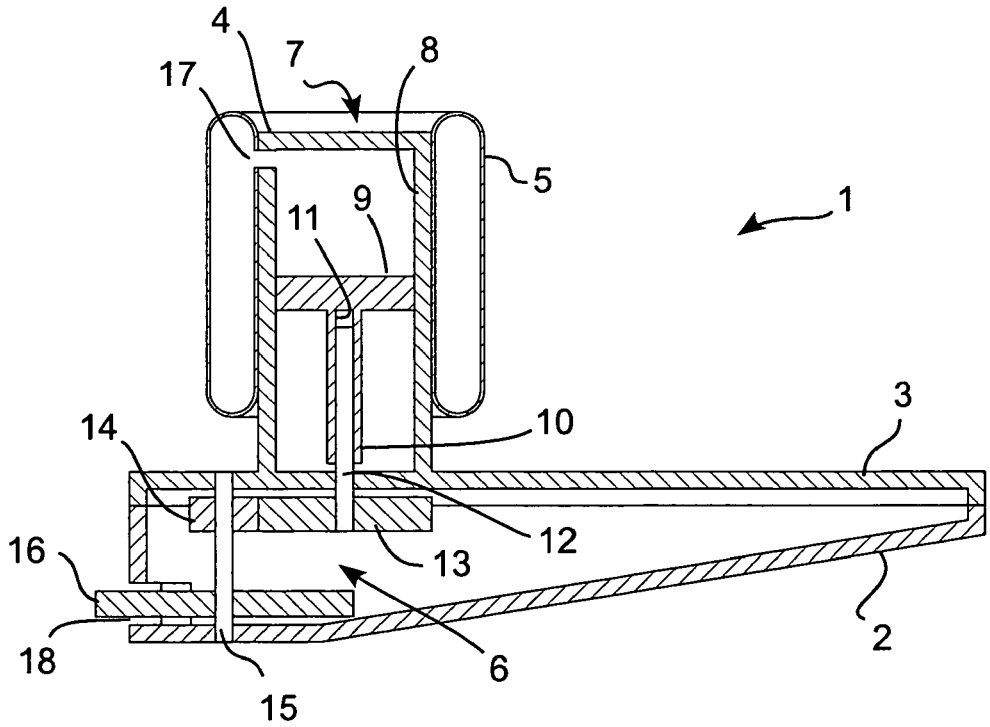
FIG. 4 shows a cross section view of the first embodiment, said cross section view defined by the line IV-IV shown in FIG. 3.
Figure 5:
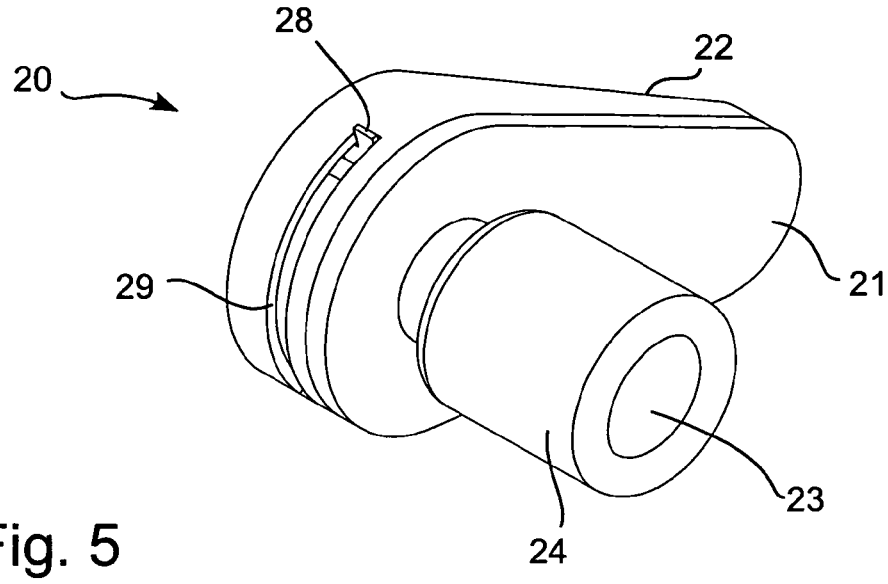
FIG. 5 shows a perspective view of a second embodiment of a sound emitting device according to the current invention.
Figure 6:
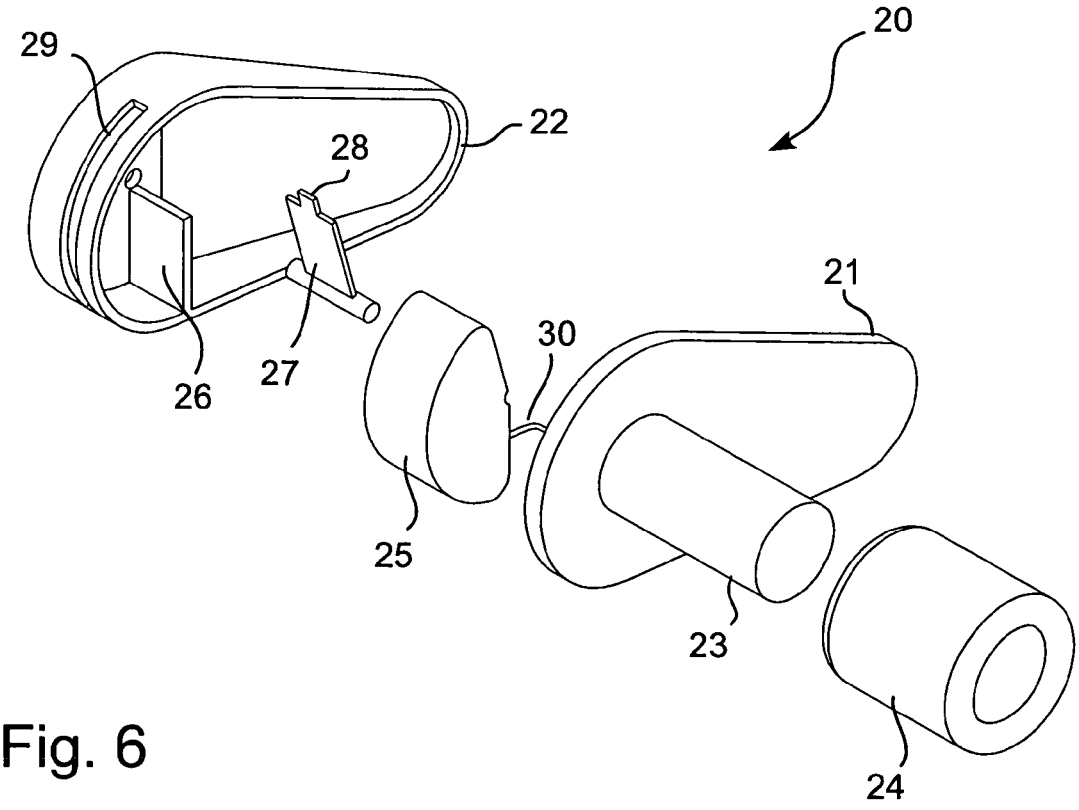
FIG. 6 shows an exploded perspective view of the second embodiment.
Figure 7:
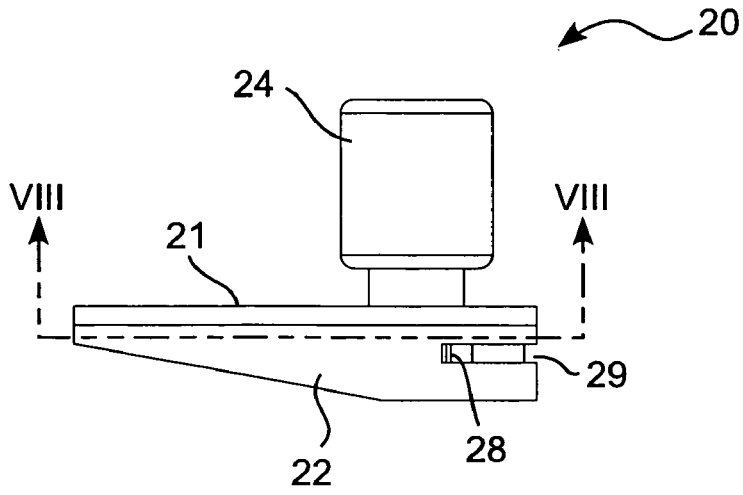
FIG. 7 shows a top view of the second embodiment.
Figure 8:
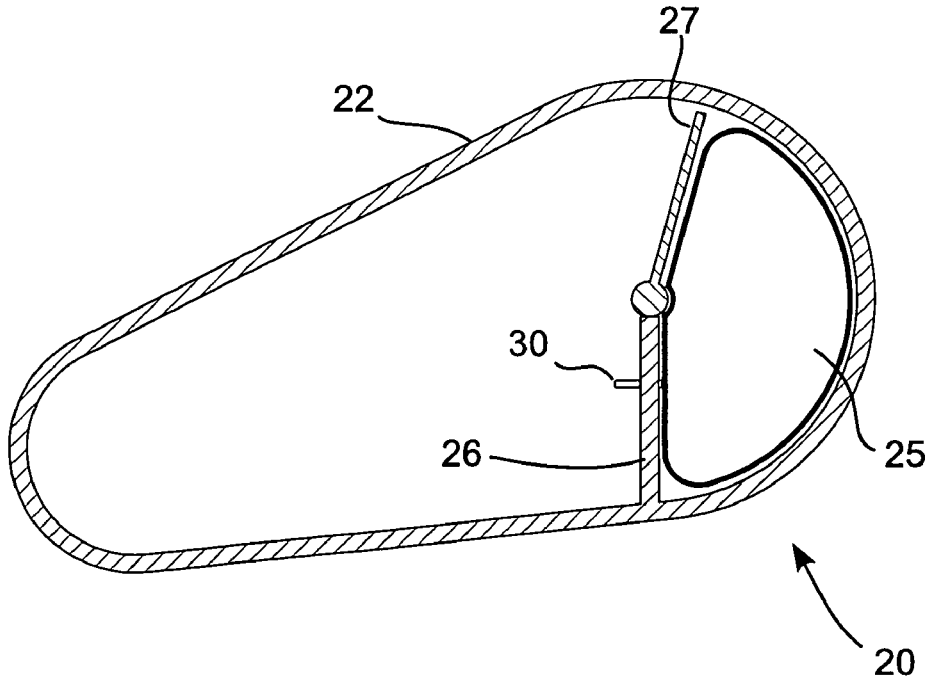
FIG. 8 shows a section view of the second embodiment, said section view being defined by the line VIII-VIII shown in FIG. 7.

It should be noted that the embodiments shown in the figures are used as examples only and should not limit the scope of the current invention. Furthermore, it should be noted that the embodiments are shown schematically in order to simplify the description. Details of the electronics have been neglected as the person skilled in the art of mobile headsets will be able to fill in the missing details. Furthermore, the mechanical details of the embodiments have also been simplified, since a person skilled in the art of mechanisms, will be able to fill in the missing details.

DETALED DESCRIPTION

FIGS. 1-4 show four different views of a first embodiment 1 of a sound emitting device according to the current invention. The first embodiment 1 is used as a wireless headset for use with a mobile telephone. The headset 1 comprises a housing 2,3 made up of an outer half 2 and an inner half 3. The inner half of the housing 3 comprises an earpiece portion 4 which can be placed inside the ear canal of a user (not shown). The earpiece portion 4 is covered by an expandable element 5 which in this particular example is a hollow sleeve made from an elastic material such as rubber. When fluid is pumped into the hollow sleeve 5, it expands. When the earpiece is placed in the ear canal of the user and the hollow sleeve is expanded, the material of the hollow sleeve presses against the inside surface of the ear canal of the user. In this way, the earpiece is held firmly in the ear of the user. Furthermore, the expandable element adapts itself to the current user's ear canal. When the user wishes to remove the headset from his or her ear, he or she removes fluid from the hollow sleeve 5 causing the hollow sleeve to retract. Once the hollow sleeve is retracted, the user can easily remove the headset from his or her ear.

In order to pump fluid into the expandable element 5, the headset 1 comprises a compressible element 7 and a compression mechanism 6 for compressing the compressible element 7. In this particular case, the compressible element 7 is comprised of a cylinder 8 and a piston 9. The compression mechanism 6 comprises a displaceable element 10 with an internal thread 11, a threaded rod 12, a first gearwheel 13, a second gearwheel 14, a shaft 15, and a disc 16. The shaft 15 is rotatably fixed in the housing 2,3. The disc 16 and the second gear wheel 14 are rigidly and coaxially attached to the shaft 15. The first gear wheel 13 is coaxially fixed to one end of the threaded rod 12. The shaft 15 and the threaded rod 12 are arranged in the housing such that the second gear wheel 12 engages with the first gear wheel 13. Therefore, when the disc 16 is rotated by the user, the shaft and the second gear wheel 14 also rotate, which in turn causes the threaded rod 12 to rotate.

The internal thread 11 of the displaceable element 10 is engaged coaxially with the threaded rod 12. The displaceable element 10 is also rigidly connected to the piston 9 of the compressible element 7 and the piston 9 is prevented from rotating in the cylinder 8. In this way, when the user rotates the disc 16, the rotation of the threaded rod 12 causes the displaceable element 10 and the piston 9 to be displaced a linear distance within the cylinder 8. This linear displacement causes the compressible element 7 to be compressed.

The compressible element 7 is connected to the hollow sleeve 5 via a channel 17 in the cylinder wall 8. The compressible element 7 and the hollow sleeve 5 are furthermore filled with a fluid. The fluid could be of many different types. One example is water. Another example is oil. The fluid could also be a gas, for example air.

Due to the above described arrangement, when the disc 16 is rotated by the user in a first direction, the compressible element 7 is compressed and fluid is forced from the compressible element 7 to the hollow sleeve 5, thereby causing the hollow sleeve 5 to expand. When the disc 16 is rotated by the user in the opposite direction, the compressible element 7 is caused to expand and fluid is sucked from the hollow sleeve 5 back into the compressible element 7, thereby causing the hollow sleeve to contract.

The outer half of the housing 2 is furthermore formed with a slot 18 through which a portion of the disc 16 protrudes. The user can therefore very easily manipulate the amount which the compressible element 7 is compressed, and therefore the amount which the expandable element 5 is expanded, just by rotating the disc 16. Furthermore, when the user stops activating the disc, the displaceable element 10 maintains its position due to the friction in the screw mechanism.

Please note, that in the current embodiment, the fluid is arranged directly in the cylinder 8. In another embodiment (not shown), a compressible bladder filled with a fluid and connected to the hollow sleeve via a hose could be arranged in the cylinder. When the piston is displaced towards the end of the cylinder, the bladder is compressed. In this way, the risk of leaks is minimized. This also reduces the need for an effective seal between the piston 9 and the cylinder 8.

It should also be noted that in the current embodiment, the first gear 13 is larger than the second gear 14. This allows the force applied by the user to be multiplied. However, in case that it is desired to decrease the amount of rotation necessary to expand the expandable element, the first gear 13 could be made smaller than the second gear 14. This will however increase the force necessary to rotate the disc.

FIGS. 5-8 show a second embodiment 20 of a sound emitting device according to the current invention. As the first embodiment 1, the second embodiment is also a headset 20 for a mobile telephone.

The headset 20 comprises a housing 21,22 made up of an inner half 21 and an outer half 22. The inner half 21 comprises an earpiece portion 23 which fits inside the ear canal of a user. The earpiece portion 23 is covered by a hollow expandable sleeve 24. Inside the housing 21,22, a compressible bladder 25 is arranged between a first surface 26 fixed to the outer half 22 of the housing and a surface of a pivotable element 27. A handle 28 on the pivotable element 27 extends through a slot 29 in the outer half 22 of the housing. The compressible bladder 25 is connected to the expandable sleeve 24 via a tube 30. The compressible bladder 25, the tube 30, and the expandable sleeve 24 form a sealed system filled with a fluid. Since the system is sealed, the risk of leaks is significantly reduced.

When the handle 28 is displaced counter-clockwise (according to the orientation shown in the figures), the bladder 25 is compressed by the pivotable element 27 and fluid is forced into the expandable sleeve 24 causing it to expand. In this way the pivotable element 27 and the first surface 26 form a sort of compression mechanism for compressing the compressible element 25.

The pivotable element 27 is held in position by a ratchet mechanism (not shown). The ratchet mechanism permits counter-clockwise motion but prevents clockwise motion.

When the user desires to release the pressure on the compressible bladder 25, the user activates a quick release mechanism (not shown) which disengages the ratchet mechanism and permits the pivotable element 26 to pivot clockwise.

The expandable sleeve 24 and the compressible bladder 25 are formed of an elastic material such as rubber. When the expandable sleeve 24 is expanded, the material of the sleeve 24 stretches. When the pressure applied to the compressible bladder 25 by the pivotable element 27 is released, the material of the sleeve 24 retracts, forcing fluid from the expandable sleeve 24 back into the compressible bladder 25.

Figure 9:
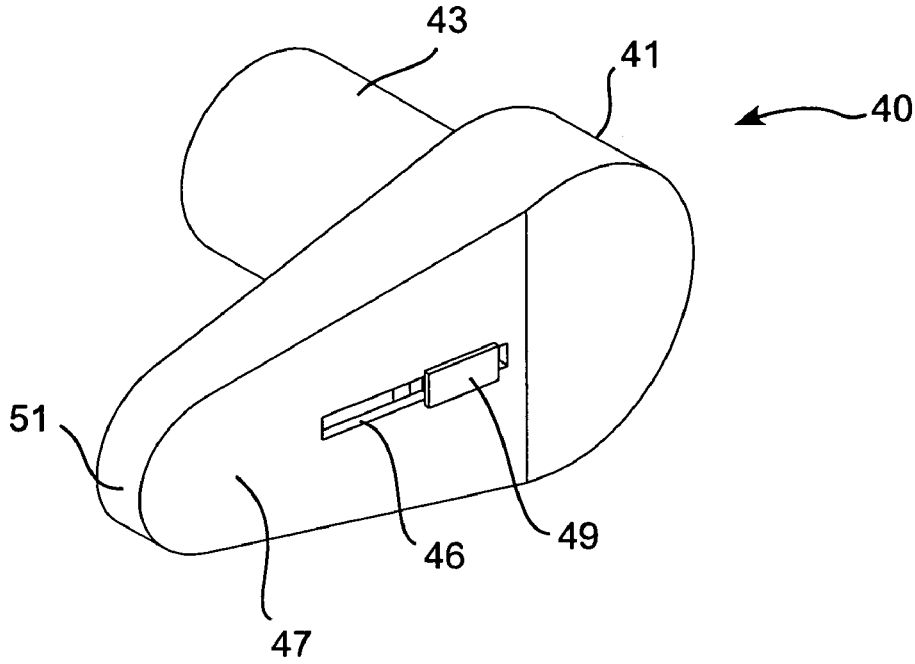
FIG. 9 shows a perspective view of a third embodiment of a sound emitting device according to the current invention.
Figure 10:
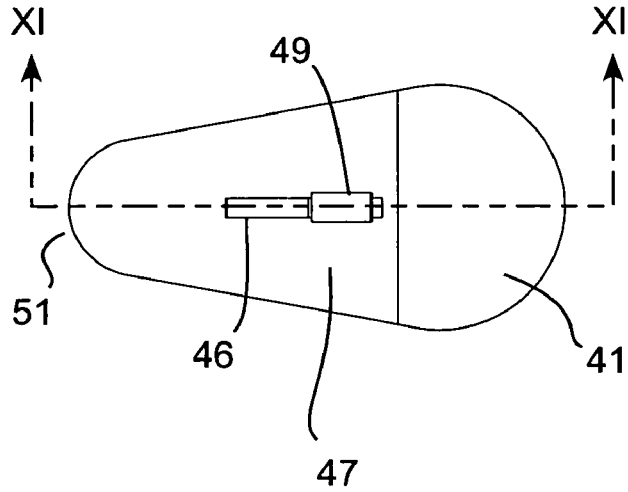
FIG. 10 shows a front view of the third embodiment.
Figure 11:
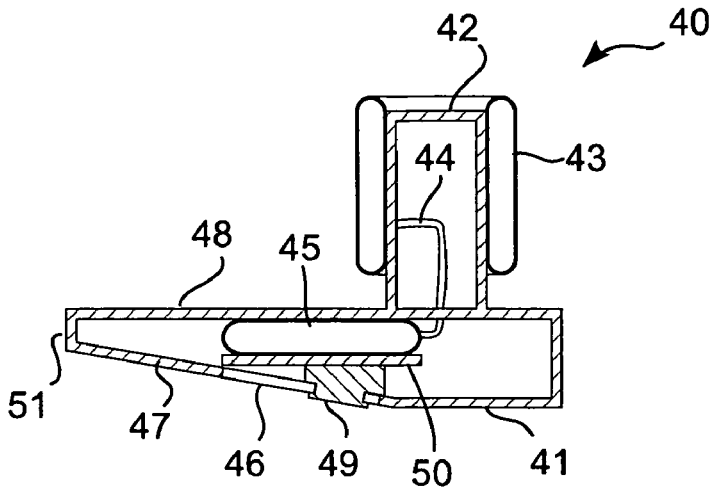
FIG. 11 shows a cross section view of the third embodiment, said cross section view being defined by the line XI-XI shown in FIG. 10.

FIGS. 9-11 show a third embodiment 40 of a sound emitting device according to the current invention. As was the case with the first two embodiments 1, 20, the third embodiment 40 is also a headset 40 for use with a mobile telephone.

The headset 40 comprises a housing 41 with an earpiece 42 which fits inside the ear canal of a user. The earpiece 42 is covered by an expandable sleeve 43. The expandable sleeve 43 is connected via a hose 44 to a compressible bladder 45. The expandable sleeve 43, hose 44, and compressible bladder 45 form a closed system which is filled with a fluid. As with the previous embodiment, when the compressible bladder 45 is compressed, the expandable sleeve 43 is expanded.

The housing 41 further comprises a slot 46 which is arranged on a surface 47 of the housing 41 which is arranged at an angle to the inside surface 48 of the housing. A slider 49 is arranged in the slot 46. When the slider 49 is slid along the slot 46, the slider also slides along a plate element 50 which is arranged in the housing such that it can displace in a direction which is perpendicular to the inside surface 48. Due to the slope of the angled surface 47, when the slider 49 slides along the slot 46, the plate element 50 is displaced towards the inside surface 48 of the housing. The compressible bladder 45 is arranged between the plate element 50 and the inside surface 48 of the housing. Therefore, when the slider 49 is displaced along the slot 46 in the direction towards the tip 51 of the housing, the compressible bladder 45 is compressed. The slider 49 and the slot 46 can be thought of as a sort of wedge mechanism which acts as a compression mechanism to compress the compressible element 45.

The amount that the expandable element is expanded can therefore easily be adjusted by the user, just by sliding the slider 49 back and forth along the slot 46. The position of the slider 49 between adjustments by the user will be held in position by the friction between the slider 49, the slot 46, and the plate element 50.

Please note that the above described embodiments have all made use of a hollow sleeve which surrounds the entire earpiece portion. However, the expandable portion could be formed in many different ways. For example, the expandable portion could be formed as a number of expandable elements placed at different locations around the outer surface of the earpiece.

Furthermore, the sound emitting devices as described above have been headsets which are used together with a mobile radio terminal, such as a mobile telephone. However, it should be obvious to the person skilled in the art that the current invention could be applied to many other types of sound emitting devices for use with many other types of electronic equipment. For example, portable music playing devices, such as an MP3 player could be imagined.

The invention claimed is:

1. A sound emitting device configured to be arrangeable at the ear of a user, said sound emitting device comprising:

an earpiece portion which fits inside the ear canal of the user, said earpiece portion comprising an expandable portion which upon expanding expands against the inside surface of the ear canal of the user;

a compressible element which is filled with a fluid and which is connected to said expandable portion whereby fluid is transferred to said expandable portion causing it to expand upon compression of said compressible element; and a compression mechanism for compressing the compressible element and in that said compression mechanism is adjustable by the user to adjust the amount which the compressible element is compressed, wherein the compressible element comprises a cylinder and a piston that are within the earpiece portion and wherein the piston is displaced relative to the cylinder to transfer the fluid between the cylinder and the expandable portion.

2. A sound emitting device according to claim 1, wherein said compression mechanism comprises a displaceable element which when displaced in a first direction compresses said compressible element.

3. A sound emitting device according to claim 2, wherein said displaceable element is held in position between adjustments via friction.

4. A sound emitting device according to claim 2, wherein said compression mechanism comprises a ratchet mechanism for holding said displaceable element in position between adjustments.

5. A sound emitting device according to claim 1, wherein said compression mechanism further comprises a quick release mechanism whereby said compression mechanism can quickly release the pressure on the compressible element.

6. A sound emitting device according to claim 1, wherein said compression mechanism comprises a screw mechanism.

7. A sound emitting device according to claim 1, wherein said compression mechanism comprises a pivoting element.

8. A sound emitting device according to claim 1, wherein said expandable portion and said compressible element are parts of a sealed system which is filled with a fluid.

9. A sound emitting device according to claim 1, wherein said sound emitting device comprises means for communicating with a mobile radio terminal.

10. A sound emitting device configured to be arrangeable at the ear of a user, said sound emitting device comprising:

an earpiece portion which fits inside the ear canal of the user, said earpiece portion comprising an expandable portion which upon expanding expands against the inside surface of the ear canal of the user;

a compressible element which is filled with a fluid and which is connected to said expandable portion whereby fluid is transferred to said expandable portion causing it to expand upon compression of said compressible element; and a compression mechanism for compressing the compressible element and in that said compression mechanism is adjustable by the user to adjust the amount which the compressible element is compressed, wherein said compression mechanism comprises a wedge mechanism that is configured to cause displacement of the fluid from the compressible element to the expandable portion when the wedge mechanism moves linearly in a first direction and to cause displacement of the fluid from the expandable portion to the compressible element when the wedge mechanism is moved in a second linear direction that is opposite the first linear direction.

11. A sound emitting device according to claim 10, wherein said wedge mechanism is held in position between adjustments via friction.

12. A sound emitting device according to claim 10, wherein said expandable portion and said compressible element are parts of a sealed system which is filled with a fluid.

13. A sound emitting device according to claim 10, wherein said sound emitting device comprises means for communicating with a mobile radio terminal.

14. A sound emitting device according to claim 10, wherein said compression mechanism comprises a ratchet mechanism for holding said displaceable element in position between adjustments.

15. A sound emitting device according to claim 10, wherein said compression mechanism further comprises a quick release mechanism whereby said compression mechanism can quickly release the pressure on the compressible element.

* * * * *

UNITED STATES PATENT AND TRADEMARK OFFICE

CERTIFICATE OF CORRECTION

PATENT NO. : 7,639,831 B2
APPLICATION NO. : 11/284042
DATED : December 29, 2009
INVENTOR(S) : Hagberg It is certified that error appears in the above-identified patent and that said Letters Patent is hereby corrected as shown below:

Column 3, Line 21: Please correct "DETALED" to read -- DETAILED --

Signed and Sealed this

Eighteenth Day of May, 2010

David J. Kappos

David J. Kappos
*Director of the United States Patent and Trademark Office*